US006083351A

United States Patent [19]

Graf et al.

[11] Patent Number: 6,083,351

[45] Date of Patent: Jul. 4, 2000

[54] DILUTION CONTROL DEVICE FOR A WET END OF A PAPER-MAKING MACHINE

[75] Inventors: Edwin X. Graf, Menasha; Dale A. Haltinner, Keshena, both of Wis.

[73] Assignee: Voith Sulzer Paper Technology North America, Inc., Appleton, Wis.

[21] Appl. No.: 09/048,145

[22] Filed: Mar. 25, 1998

[51] Int. Cl.[7] ..... D21F 1/08

[52] U.S. Cl. ..... 162/343; 162/258

[58] Field of Search ..... 162/258, 343, 162/336

[56] References Cited

U.S. PATENT DOCUMENTS

| | | | |
|---|---|---|---|
| 4,225,386 | 9/1980 | Edblom et al. | 162/343 |
| 5,695,611 | 12/1997 | Bubik et al. | 162/343 |
| 5,707,495 | 1/1998 | Heinzmann et al. | 162/343 |
| 5,795,441 | 8/1998 | Lehleiter et al. | 162/343 |
| 5,814,191 | 9/1998 | Huovila | 162/343 |

FOREIGN PATENT DOCUMENTS 4437180 3/1995 Germany .

*Primary Examiner*—Karen M. Hastings
*Attorney, Agent, or Firm*—Taylor & Aust, P.C.

[57] ABSTRACT

A dilution control device interconnects a tapered header with a turbulence generator in a paper-making machine. The turbulence generator includes a substantially planar inlet surface and a plurality of fluid passages, with each fluid passage having an inlet at the inlet surface. The tapered header includes a header plate with a plurality of outlets therein, with each outlet being associated with at least one inlet of the turbulence generator. A dilution module block is positioned between and interconnects the header plate with the inlet surface of the turbulence generator. The dilution module block includes a plurality of through holes and a plurality of feed channels. Each through hole interconnects an outlet of the tapered header with at least one inlet of the turbulence generator. Each feed channel is in fluid communication with at least one through hole and is configured for transporting dilution water to a corresponding through hole. A plurality of inserts are disposed within corresponding ones of the through holes. Each insert includes a primary opening and a side entry hole. The primary opening interconnects an outlet of the tapered header with a corresponding inlet of the turbulence generator. The side entry hole interconnects the primary opening with a corresponding feed channel.

22 Claims, 5 Drawing Sheets

DILUTION CONTROL DEVICE FOR A WET END OF A PAPER-MAKING MACHINE

BACKGROUND OF THE INVENTION

1. Field of the Invention

The present invention relates to paper-making machines, and, more particularly, to a wet end of a paper-making machine.

2. Description of the Related Art

A wet end of a paper-making machine partially includes a headbox, a wire and a former associated with the wire. The headbox receives prepared fiber stock in the form of a prepared fiber suspension. The headbox has a nozzle section which extends substantially across the width of the wire and the fiber stock is discharged with a known cross sectional profile from the nozzle section onto the wire.

It is known to provide a turbulence generator at the inlet to the headbox. The turbulence generator assists in deflocculating the fiber stock which enters the headbox. For example, referring to FIG. 1, it is known to provide a turbulence generator in the form of a diffuser plate which is attached to the inlet of the headbox. The diffuser plate includes a plurality of through holes which are disposed substantially parallel to each other and extend in the flow direction toward the inlet of the headbox. The diffuser plate provides a more even flow distribution of the fiber stock which is transported into the headbox and assists in deflocculating the fiber stock. The diffuser plate may be connected in a conventional manner with a tapered header. The taper angle on the tapered header is selected such that the velocity decrease caused by fiber stock flowing through the through holes in the diffuser is substantially offset by the velocity increase caused by the reduced cross sectional area associated with the taper angle, thereby resulting in a substantially constant flow rate into the headbox across the diffuser plate.

It is also known to provide a turbulence generator in the form of a tube bundle including a plurality of tubes which are connected at one end thereof to the headbox inlet, and connected at the other end thereof to a source of fiber stock. A tube bundle of this type also assists in deflocculating the fiber stock entering the headbox inlet. Such a tube bundle is incorporated into the "VALLEY" headbox marketed by the assignee of the present invention.

It is further known to control "on the fly" the concentration of the fiber stock which is transported into a headbox. Varying the concentration of the fiber stock immediately prior to the fiber stock entering the headbox inlet is known as "dilution control". For example, with a headbox including a diffuser plate with a plurality of through holes as described above, it is known to inject clean water into the fiber stock flowing through a particular through hole to thereby dilute the fiber stock to a particular concentration. A problem with using clean water for dilution control in this manner is that the clean water is obtained from a source, such as well water, having a temperature and Ph which are different from the fiber stock flowing through the associated through hole in the diffuser plate. Thus, heat and/or chemicals may need to be added to the clean water to obtain the proper temperature and Ph. A more significant problem is that the introduction of clean water into the flow of fiber stock which is flowing through a through hole in the diffuser plate causes a local increase in the flow rate of the fiber stock which flows through the headbox. This local flow rate generally is transmitted to the nozzle, resulting in a localized increased flow rate of the fiber stock from the nozzle which is undesirable.

It is also known to provide dilution control in conjunction with a conventional hydraulic headbox. For example, it is known to provide a relatively large tapered header through which headbox consistency fiber stock flows. The headbox consistency fiber stock is transported from the larger tapered header through a plurality of fluid passages. A smaller tapered header carries lean whitewater which is recirculated from the portion of the wet end associated with the wire and former(s). The lean whitewater is primarily water which has drained from the fiber stock carried on the wire in the wet end, but also includes a small amount of fibers therein. The lean whitewater is substantially at the correct temperature and Ph since it has already been treated prior to being previously introduced into the headbox. The lean whitewater is transported from the smaller tapered header through a plurality of fluid passages which respectively merge with the fluid passages associated with the larger tapered header. Depending upon the angle between each pair of merging fluid passages and the flow rate of the lean whitewater through the fluid passages, the main flow through the fluid passages associated with the larger tapered header may be somewhat retarded to provide dilution control without increasing the flow rate from each fluid passage. Such a dilution control apparatus thus provides effective dilution control without changing the localized flow rate of the fiber stock flowing through the headbox. A dilution control apparatus of this type is marketed by the assignee of the present invention under the trademark "MODULE JET".

The MODULE JET dilution control apparatus as described above also allows for "fiber orientation" of the fiber stock which is discharged from the nozzle of the headbox onto the wire of the wet end. In general, fiber orientation is the direction which each fiber generally extends relative to the running direction of the machine when the fiber stock is discharged onto the wire. It has been found to be preferable to orient the fibers of the fiber stock on the wire at a relatively small acute angle relative to the machine running direction. The MODULE JET fiber orientation apparatus has been found to be effective in providing fiber orientation of the fiber stock on a wire as well as dilution control.

What is needed in the art is a dilution control device for use at the wet end of a paper-making machine which provides accurate dilution control, and simply and easily interconnects a tapered header with a tube bundle of a headbox.

SUMMARY OF THE INVENTION

The present invention provides a dilution control device in the form of a dilution module block which interconnects a tapered header with a turbulence generator and includes a plurality of through holes therein for receiving headbox consistency fiber stock and a plurality of feed channels for transporting dilution water to the through holes for diluting the fiber stock.

The invention comprises, in one form thereof, a dilution control device interconnecting a tapered header with a turbulence generator in a paper-making machine. The turbulence generator includes a substantially planar inlet surface and a plurality of fluid passages, with each fluid passage having an inlet at the inlet surface. The tapered header includes a header plate with a plurality of outlets therein, with each outlet being associated with at least one inlet of the turbulence generator. A dilution module block is positioned between and interconnects the header plate with the inlet surface of the turbulence generator. The dilution module block includes a plurality of through holes and a plurality of feed channels. Each through hole interconnects an outlet of the tapered header with at least one inlet of the turbulence generator. Each feed channel is in fluid communication with at least one through hole and is configured for transporting dilution water to a corresponding through hole. A plurality of inserts are disposed within corresponding ones of the through holes. Each insert includes a primary opening and a side entry hole. The primary opening interconnects an outlet of the tapered header with a corresponding inlet of the turbulence generator. The side entry hole interconnects the primary opening with a corresponding feed channel.

An advantage of the present invention is that the dilution module block is constructed as a single block which is simply interconnected between the tapered header and turbulence generator.

Another advantage is that the through holes and feed channels are machined into the dilution module block, thereby simplifying the overall structure.

Yet another advantage is that the size, shape and angular relationship of and between the feed channels, through holes, side entry holes and/or primary openings may be selected for a particular application.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
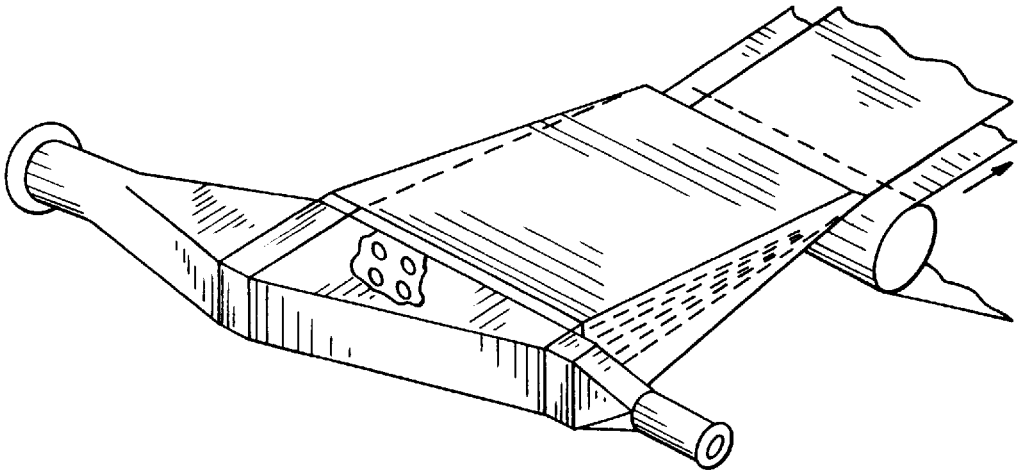
PRIOR ART Fig. 1
FIG. 1 is a fragmentary, perspective view of a portion of a prior art wet end for a paper-making machine, including a tapered header connected directly with a diffuser associated with a headbox.
Figure 2:
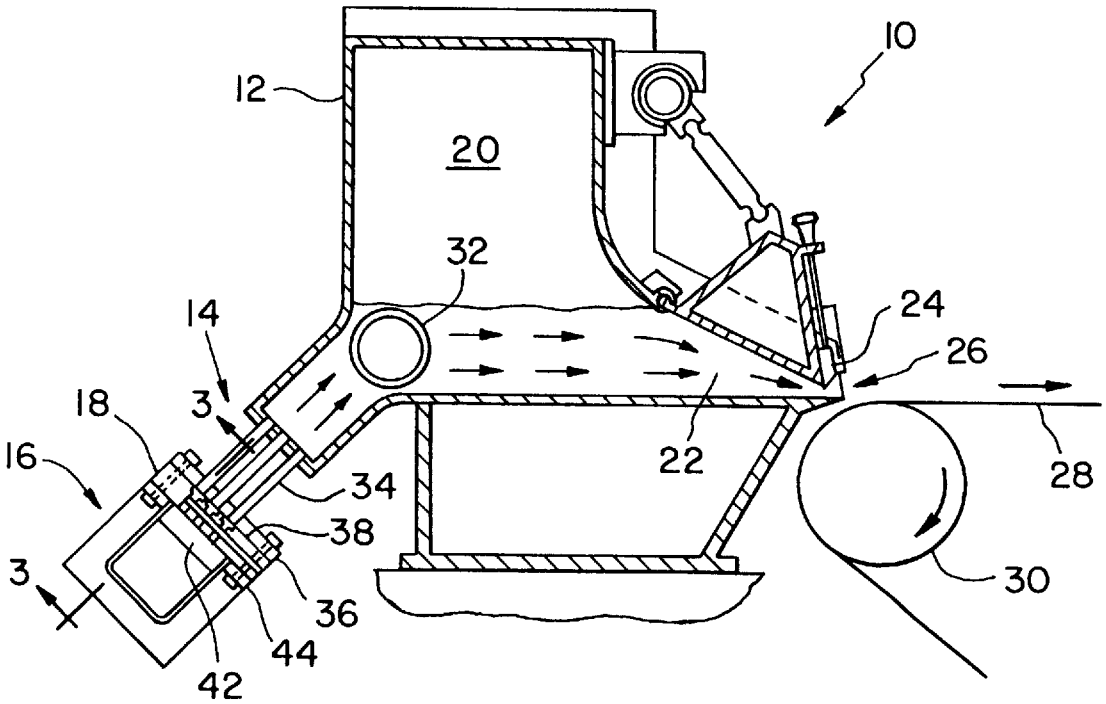
FIG. 2 is a side view of an embodiment of a wet end of the present invention, including an embodiment of a dilution module block of the present invention.
Figure 3:
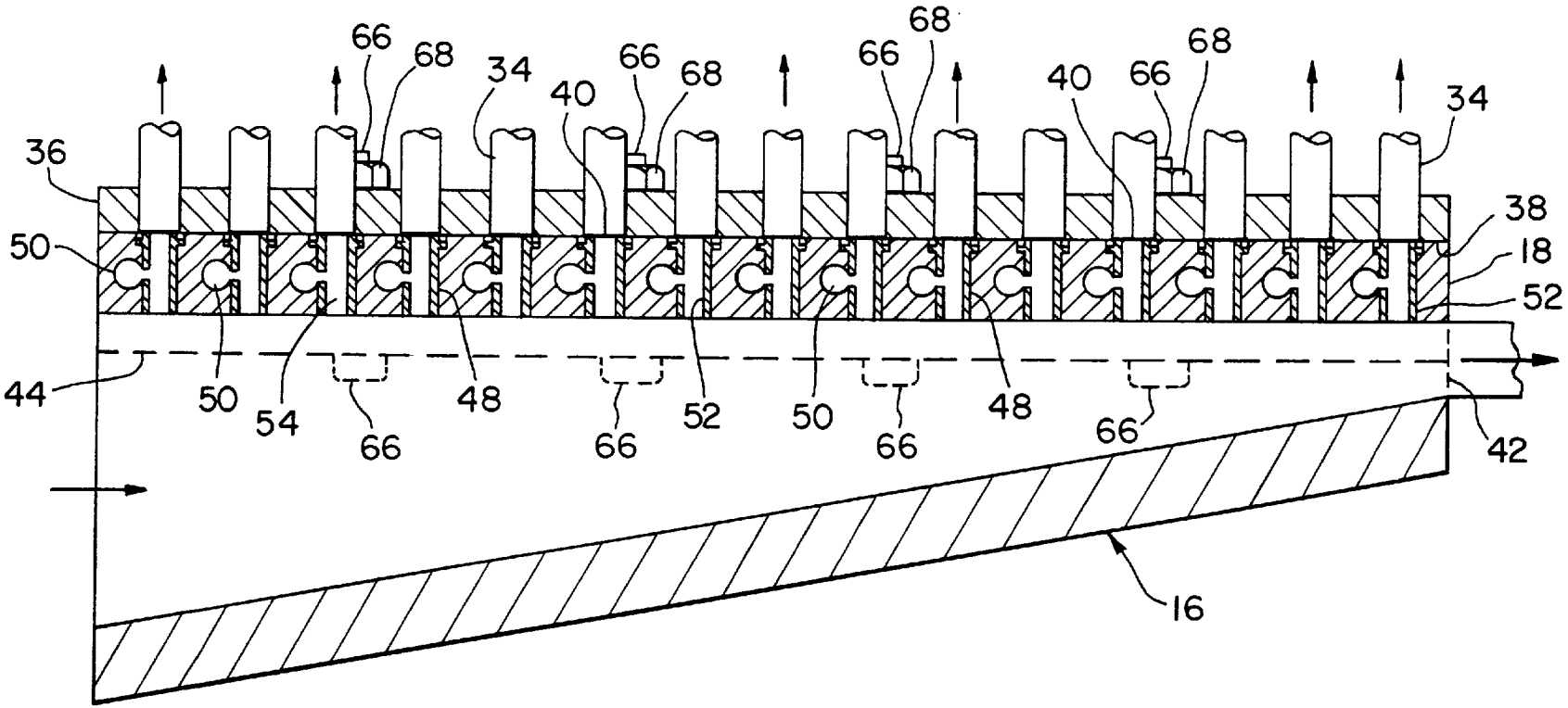
FIG. 3 is a fragmentary, top view of the dilution module block shown in FIG. 2.

Referring now the drawings, and more particularly to FIGS. 2 and 3, there is shown a wet end 10 of a paper-making machine, including a headbox 12, turbulence generator 14, tapered header 16 and dilution module block 18.

Headbox 12 is configured as a "VALLEY" (TM) headbox, manufactured and distributed by the assignee of the present invention. Headbox 12 includes a chamber 20 and discharge nozzle 22. A slice lip 24 is disposed at the down stream end of discharge nozzle 22, and defines an outlet gap 26, through which the fiber stock is discharged onto a wire 28 carried by a breast roll 30. A distributor roll, such as a perforated distributor roll 32, is disposed within chamber 20 towards the upstream end thereof, and assists in deflocculating the fiber stock flowing through headbox 12.

Turbulence generator 14, which also may generically be known as a distributor, is in the form of a tube bundle in the embodiment shown which is integrally connected with headbox 12. More particularly, tube bundle 14 includes a plurality of tubes 34 which are connected with headbox 12 at one end thereof and are connected to a tube plate 36 at the opposite end thereof. Tube plate 36 defines a substantially planar inlet surface 38 with a plurality of inlets 40 formed therein. Each tube 34 is placed within a corresponding inlet 40 in plate 36, such that the internal fluid passage defined thereby is in fluid communication with a corresponding inlet 40 at inlet surface 38. In the embodiment shown, tubes 34 are disposed a substantially equal distance from each other when viewed from the end (i.e., in a staggered or checkerboard relationship relative to each other). Tubes 34 assist in generating turbulence within the fiber stock flowing therethrough, and thereby assist in deflocculating the fiber stock entering headbox 12. Turbulence generator 14 is integral with head box 12 in the embodiment shown; but may be separate from and attached to headbox 12.

Turbulence generator 14 may of course include a number of rows and columns of tubes 34 which is desirable for a specific application. In the section shown in FIG. 2, three rows of tubes 34 are shown. However, it is to be understood that turbulence generator 14 shown in FIGS. 2 and 3 actually includes six rows of tubes 34. More particularly, the next three tubes which are positioned behind the three tubes shown in FIG. 2 would be offset to the right from the three tubes shown in FIG. 2. Thus, the tubes 34 shown in FIGS. 2 and 3 would define a checkerboard if viewed parallel to the direction of flow.

Tapered header 16 having a header plate 44 transports headbox consistency fiber stock which has been treated for use in headbox 12. The section through the drawing in FIG. 2 is taken near the inlet end of tapered header 16 which is of a larger cross-section. Tapered header 16 tapers in known manner to an opposite end where an exit 42 of smaller cross-sectional area is located. The taper angle on tapered header 16 is selected such that the velocity decrease caused by fiber stock flowing through outlets 46 is substantially offset by the velocity increase caused by the reduced cross-sectional area associated with the taper angle, thereby resulting in a substantially constant flow rate into headbox 12. In the embodiment shown, tapered header 16 has an internal chamber with a cross-sectional area which is substantially rectangular and tapers toward the discharge end adjacent exit 42. However, it will also be appreciated that tapered header 16 may have an internal chamber with a circular or other desired cross-sectional shape.

Dilution module block 18 is positioned between and interconnects header plate 44 of tapered header 16 with substantially planar inlet surface 38 of turbulence generator 14. Dilution module bock 18 is in the form of a substantially solid block of material, such as metal, which is machined to include a plurality of through holes 48 and a plurality of feed channels 50. Each through hole 48 interconnects an outlet 46 of tapered header 16 with at least one inlet 40 of turbulence generator 14. In the embodiment shown, each through hole 48 interconnects an outlet 46 with a single inlet 40. Each feed channel 50 is disposed in fluid communication with at least one through hole 48 and is configured for transporting dilution water to the corresponding at least one through hole. In the embodiment shown, each feed channel 50 is in fluid communication with three through holes 48, and is configured for transporting dilution water to each of the three through holes 48 associated therewith. The dilution water transported through feed channels 50 may be in the form of white water, lean white water or fresh water, depending upon the particular application. Feed channels 50 of dilution module block 18 preferably receive and transport clean white water which is recirculated from the wet end of the paper-making machine. Since the lean white water has already been treated and is at approximately the correct temperature and PH level, the lean white water may again be utilized without substantial treatment cost being incurred.

Figure 4:
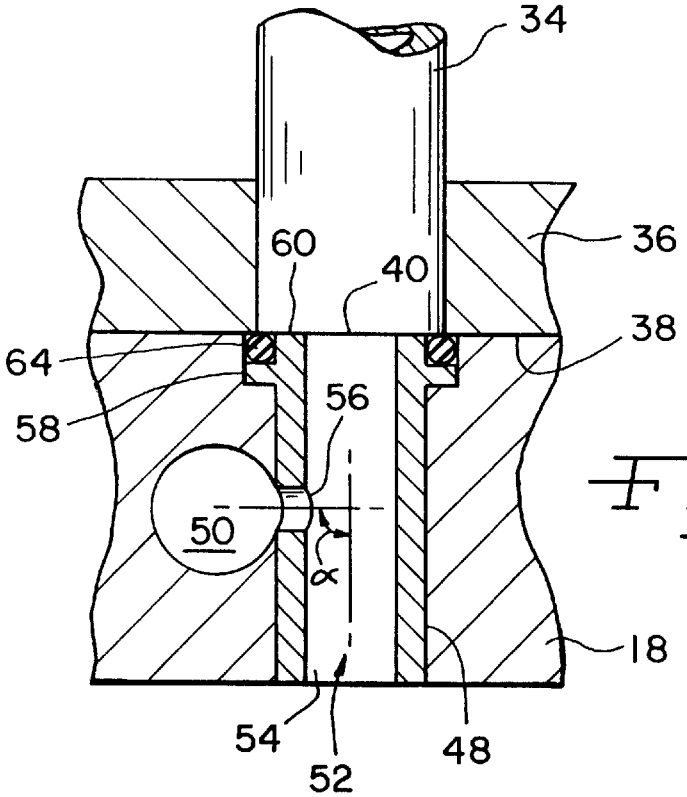
FIG. 4 is an enlarged, side view of an embodiment of an insert shown in FIGS. 2 and 3, installed between the tapered header and turbulence generator.
Figure 5:
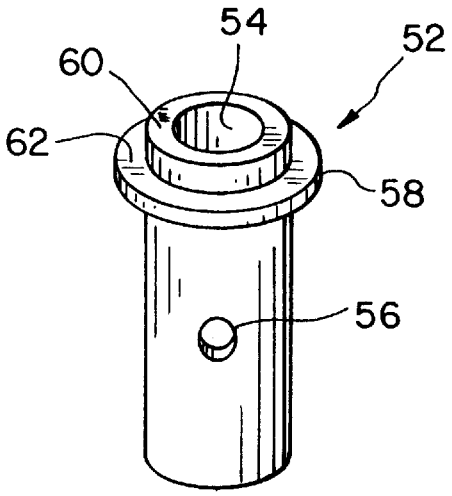
FIG. 5 is a perspective view of the insert shown in FIGS. 24.

Dilution module block 18 also includes a plurality of inserts 52 which are disposed within corresponding through holes 48. Referring to FIGS. 4 and 5, each insert 52 includes a primary opening 54 and a side entry hole 56. Primary opening 54 interconnects an outlet 46 of tapered header 16 with a corresponding inlet 40 of turbulence generator 14. Side entry hole 56 interconnects primary opening 54 with a corresponding feed channel 50. A radially outwardly projecting flange 58 is positioned adjacent to an axial face 60. A continuous groove 62 is formed in axial face 60 at the periphery thereof and surrounds primary opening 54. Axial face 60 engages substantially planar inlet surface 38 of turbulence generator 14. A seal 64 is placed within groove 62 and seals between axial face 60, inlet surface 38 and through hole 48. That is, seal 64 is compressed when dilution module block 18 is connected to tube place 36 and forms an effective fluid seal.

Each insert 52 is positioned such that the side entry hole 56 thereof is disposed in fluid communication with a corresponding feed channel 50. To ensure proper alignment of insert 52 within through hole 48, insert 52 and through hole 48 may be formed with a keying arrangement. For example, each insert 52 may be formed with a projecting key which is received within a corresponding slot formed in the inside diameter of through holes 48. Alternatively, each insert 52 may be formed with a cross-sectional shape (e.g., rectangular, etc.) which mates with a similarly configured cross-sectional shape of a corresponding through hole. In the embodiment shown, each insert 52 has a circular cross section, and each corresponding primary opening 54 and side entry hole 56 also has a circular cross-section. However, it will be appreciated that the particular shape and/or cross-section of each insert 52, primary opening 54 and side entry hole 56 may have any of a number of different shapes and/or sizes depending upon the particular application.

Side entry hole 56 may be disposed at an angle of other than 90° relative to primary opening 54. That is, side entry hole 56 has a longitudinal axis which may be disposed at an angle $\alpha$ (FIG. 4) to the longitudinal axis of each primary opening 54 which is selected such that the headbox consistency stock flowing through primary opening 54 is diluted with the lean white water flowing from the side entry hole 56 and mixing therewith, without a localized increase in the localized flow rate flowing from primary opening 54. More particularly, the angle $\alpha$ may be selected such that the headbox consistency fiber stock flowing through primary opening 54 is retarded to a predetermined amount at the point of mixing with the lean white water from side entry hole 56. The fiber stock may thus be diluted while maintaining the local flow rate at a substantially constant level.

To assemble dilution module bock 18, inserts 52 having primary openings 54 and side entry holes 56 with a desired size, shape and angular orientation are placed within corresponding through holes 48 of dilution module block 18. Dilution module block 18 is placed against tube plate 36. Header plate 44 is placed against the opposite side of dilution module block 18. Bolts 66 are placed through corresponding aligned openings formed in each of tube plate 36, dilution module block 18 and header plate 44, and nuts 68 are tightened to an appropriate torque value.

Figure 6:
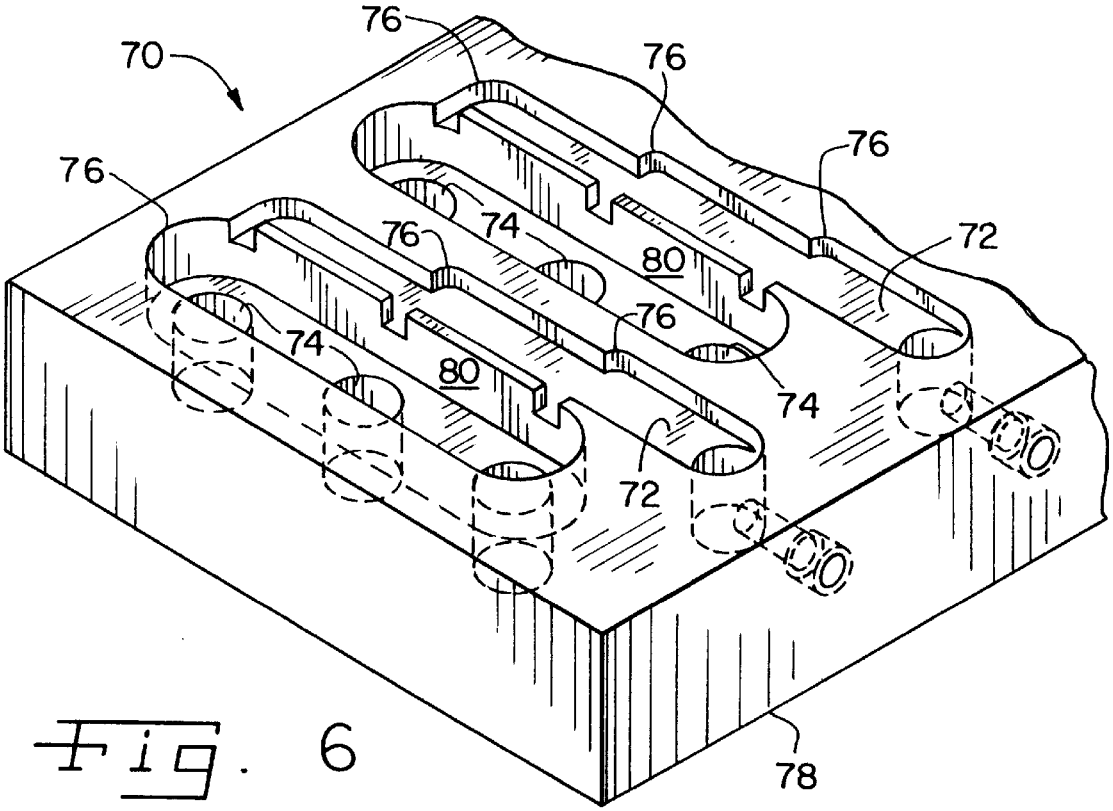
FIG. 6 is a perspective view of another embodiment of a dilution module block of the present invention.

FIG. 6 illustrates another embodiment of a dilution module block 70 of the present invention. Dilution module block 70 is formed from a solid piece of metal, with feed channels 72 and through holes 74 machined therein. Each feed channel 72 is disposed in communication with three associated through holes 74 and transports dilution water for mixing with the head stock consistency fiber stock transported through through holes 74. Each feed channel 72 includes one wall which is stepped with radii 76 which respectively direct a portion of the dilution water toward an associated through hole 74. Through holes 74 extend from a side 78 adjacent header plate 44 to a chamber 80 adjacent tube plate 36. Chamber 80 thus receives head stock consistency fiber stock from an associated three through holes 74. The head box consistency fiber stock entering chamber 80 mixes with dilution water flowing from feed channel 72, and the diluted fiber stock is fed to a corresponding three tubes 34 of turbulence generator 14.

Figure 7:
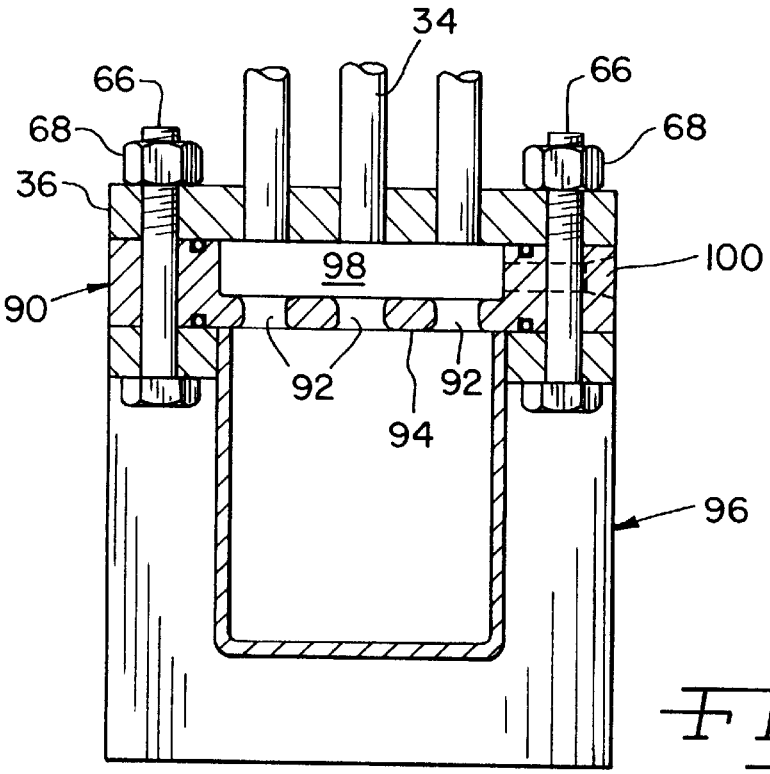
FIG. 7 is an end view of yet another embodiment of a dilution module block of the present invention, installed between a tapered header and turbulence generator.

FIG. 7 illustrates yet another embodiment of a dilution module block 90 of the present invention. Dilution module block 90 includes a plurality of through holes 92 spaced across the length thereof, three of which are shown. Each through hole 92 extends from a side 94 adjacent tapered header 96 to a chamber 98 adjacent tube plate 36. A plurality of feed channels 100, one of which is shown, feed directly into an end of chamber 98. That is, in contrast with feed channels 50 and 72 shown in FIGS. 2–3 and 6, each feed channel 100 does not extend along the side of chamber 98 with side entry ports in communication with chamber 98. Rather, each feed channel 100 extends to and provides dilution water at a single location within chamber 98. Chamber 98 thus acts as a mixing chamber for mixing the head stock consistency fiber stock flowing through through holes 92 with the dilution water flowing through feed channel 100. Each chamber 98 is disposed in fluid communication with three tubes 34 carried by tube plate 36.

Figure 8:
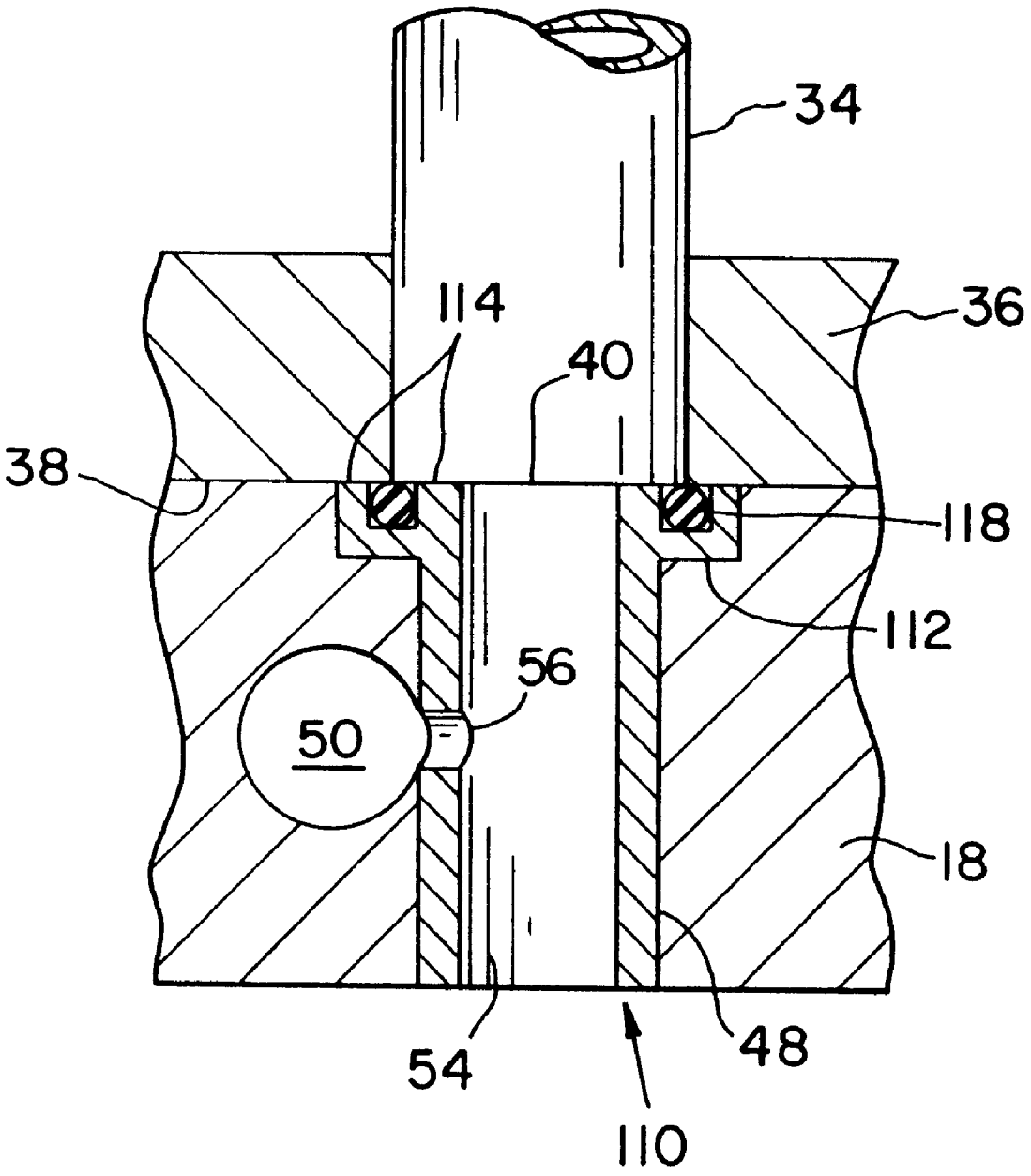
FIG. 8 is an enlarged, side view of another embodiment of an insert of the present invention, installed between a tapered header and turbulence generator.

FIG. 8 illustrates another embodiment of an insert 110 of the present invention, installed within a dilution module block 18 and engaged with tube plate 36. Insert 110 includes a primary opening 54 and a side entry hole 56, similar to insert 52 described above with reference to FIGS. 2–5. A radially outwardly projecting flange 112 is positioned adjacent to an axially face 114. A continuous annular groove 116 is formed in axial face 114 and surrounds primary opening 54. Axial face 114 engages substantially planar inlet surface 38 of turbulence generator 14. A seal 118 is placed within groove 116 and seals between axial face 114, inlet surface 38 and through hole 48. Flange 112 includes an axially extending portion which in part defines axial face 114. Insert 110 therefore essentially wraps around three sides of seal 118.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wet end of a paper-making machine, comprising:

a headbox including a chamber and a discharge nozzle;

a turbulence generator connected with said headbox, said turbulence generator including a substantially planar inlet surface and a plurality of fluid passages, said plurality of fluid passages disposed substantially parallel to each other, each said fluid passage being in fluid communication with said headbox chamber and having an inlet at said inlet surface;

a tapered header for transporting headbox consistency fiber stock;

a dilution module block positioned between and interconnecting said tapered header with said inlet surface of said turbulence generator, said dilution module block including:

a plurality of through holes, each said through hole interconnecting said tapered header with at least one said inlet of said turbulence generator;

a plurality of feed channels, each said feed channel being in fluid communication with at least one said through hole and configured for transporting dilution water to said corresponding at least one through hole; and a plurality of inserts, each said insert having a fixed position relative to and within a corresponding said through hole, each said insert including a primary opening and a side entry hole, said primary opening interconnecting said tapered header with a corresponding said inlet of said turbulence generator, said side entry hole interconnecting said primary opening with a corresponding said feed channel, each said insert having an axial face abutting a corresponding said inlet of said turbulence generator; and at least one seal, each said seal surrounding at least a portion of a corresponding said axial face and being compressed between a corresponding said insert and a corresponding said inlet of said turbulence generator.

2. The wet end of claim 1, wherein each said insert includes means for orienting said side entry hole relative to said corresponding feed channel.

3. The wet end of claim 1, wherein each said insert has a circular cross section.

4. The wet end of claim 3, wherein each said primary opening and each said side entry hole has a circular cross section.

5. The wet end of claim 1, wherein said turbulence generator comprises a tube plate and a plurality of tubes, said tube plate including said inlet surface, said plurality of tubes being connected to said headbox at one end thereof and being connected to said tube plate at an opposite end thereof.

6. The wet end of claim 1, wherein each said primary opening is substantially aligned with a respective said inlet of said turbulence generator.

7. The wet end of claim 1, wherein each said primary opening is configured to discharge the fiber stock in a direction substantially parallel to said fluid passages in said turbulence generator.

8. The wet end of claim 1, wherein each said through hole interconnects said tapered header with a respective said inlet of said turbulence generator.

9. The wet end of claim 1, wherein said turbulence generator is integral with said headbox.

10. The wet end of claim 1, wherein each said through hole is associated with a respective said inlet of said turbulence generator.

11. A wet end of a paper-making machine, comprising:

a headbox including a chamber and a discharge nozzle;

a turbulence generator connected with said headbox said turbulence generator including a substantially planar inlet surface and a plurality of fluid passages, said plurality of fluid passages disposed substantially parallel to each other, each said fluid passage being in fluid communication with said headbox chamber and having an inlet at said inlet surface;

a tapered header for transporting headbox consistency fiber stock; and a dilution module block positioned between and interconnecting said tapered header with said inlet surface of said turbulence generator, said dilution module block including:

a plurality of through holes, each said through hole interconnecting said tapered header with at least one said inlet of said turbulence generator;

a plurality of feed channels each said feed channel being in fluid communication with at least one said through hole and configured for transporting dilution water to said corresponding at least one through hole; and a plurality of inserts, each said insert having a circular cross section and a radially outwardly projecting flange positioned adjacent to said planar inlet surface of said turbulence generator, each said insert disposed within a corresponding said through hole and including a primary opening and a side entry hole, said primary opening interconnecting said tapered header with a corresponding said inlet of said turbulence generator, said side entry hole interconnecting said primary opening with a corresponding said feed channel.

12. A wet end of a paper-making machine, comprising:

a headbox including a chamber and a discharge nozzle;

a turbulence generator connected with said headbox, said turbulence generator including a substantially planar inlet surface and a plurality of fluid passages, said plurality of fluid passages disposed substantially parallel to each other, each said fluid passage being in fluid communication with said headbox chamber and having an inlet at said inlet surface;

a tapered header for transporting headbox consistency fiber stock;

a dilution module block positioned between and interconnecting said tapered header with said inlet surface of said turbulence generator, said dilution module block including:

a plurality of through holes, each said through hole interconnecting said tapered header with at least one said inlet of said turbulence generator;

a plurality of feed channels each said feed channel being in fluid communication with at least one said through hole and configured for transporting dilution water to said corresponding at least one through hole; and a plurality of inserts, each said insert having a circular cross section and a radially outwardly projecting flange positioned adjacent to said turbulence generator, each said insert disposed within a corresponding said through hole and including a primary opening and a side entry hole, said primary opening interconnecting said tapered header with a corresponding said inlet of said turbulence generator, said side entry hole interconnecting said primary opening with a corresponding said feed channel, each said insert having an axial face adjacent to said turbulence generator and a continuous groove in said axial face surrounding said primary opening; and at least one seal, each said seal being disposed in a corresponding one of said continuous grooves.

13. A wet end of a paper-making machine, comprising:

a headbox including a chamber and a discharge nozzle;

a turbulence generator connected with said headbox, said turbulence generator including a substantially planar inlet surface and a plurality of fluid passages, said plurality of fluid passages disposed substantially parallel to each other, each said fluid passage being in fluid communication with said headbox chamber and having an inlet at said inlet surface;

a tapered header for transporting headbox consistency fiber stock;

a dilution module block positioned between and interconnecting said tapered header with said inlet surface of said turbulence generator, said dilution module block including:

a plurality of through holes, each said through hole interconnecting said tapered header with at least one said inlet of said turbulence generator;

a plurality of feed channels each said feed channel being in fluid communication with at least one through hole and configured for transporting dilution water to said corresponding at least one through hole; and a plurality of inserts, each said insert disposed within a corresponding said through hole and including a primary opening and a side entry hole, said primary opening interconnecting said tapered header with a corresponding said inlet of said turbulence generator, said side entry hole interconnecting said primary opening with a corresponding said feed channel, each said insert having an axial face adjacent to said turbulence generator and a continuous groove in said axial face surrounding said primary opening; and at least one seal, each said seal being disposed in a corresponding one of said continuous grooves.

14. In a paper-making machine, a dilution control device interconnecting a tapered header with a turbulence generator, the turbulence generator including a substantially planar inlet surface and a plurality of fluid passages, each fluid passage having an inlet at the inlet surface, the improvement comprising:

a dilution module block positioned between and interconnecting the tapered header with the inlet surface of the turbulence generator, said dilution module block including:

a plurality of through holes, each said through hole interconnecting the tapered header with at least one inlet of the turbulence generator;

a plurality of feed channels, each said feed channel being in fluid communication with at least one said through hole and configured for transporting dilution water to said corresponding at least one through hole; and a plurality of inserts, each said insert having a fixed position relative to and within a corresponding said through hole, each said insert including a primary opening and a side entry hole, said primary opening interconnecting said tapered header with a corresponding said inlet of said turbulence generator, said side entry hole interconnecting said primary opening with a corresponding said feed channel, each said insert having an axial face abutting a corresponding said inlet of said turbulence generator; and at least one seal, each said seal surrounding at least a portion of a corresponding said axial face and being compressed between a corresponding said insert and a corresponding said inlet of said turbulence generator.

15. The wet end of claim 14, wherein each said insert has a circular cross section.

16. The wet end of claim 15, wherein each said primary opening and each said side entry hole has a circular cross section.

17. The wet end of claim 14, wherein each said insert includes means for orienting said side entry hole relative to said corresponding feed channel.

18. In a paper-makinz machine, a dilution control device interconnecting a tapered header with a turbulence generator, the turbulence generator including a substantially planar inlet surface and a plurality of fluid passages, each fluid passage having an inlet at the inlet surface, the improvement comprising:

a dilution module block positioned between and interconnecting the tapered header with the inlet surface of the turbulence generator, said dilution module block including:

a plurality of through holes, each said through hole interconnecting the tapered header with at least one inlet of the turbulence generator, a plurality of feed channels, each said feed channel being in fluid communication with at least one said through hole and configured for transporting dilution water to said corresponding at least one through hole; and a plurality of inserts, each said insert having a circular cross section and a radially outwardly projecting flange positioned adjacent to the planar inlet surface of said turbulence generator, each said insert disposed within a corresponding said through hole and including a primary opening and a side entry hole, said primary opening interconnecting said tapered header with a corresponding said inlet of said turbulence generator, said side entry hole interconnecting said primary opening with a corresponding said feed channel.

19. In a paper-making machine, a dilution control device interconnecting a tapered header with a turbulence generator, the turbulence generator including a substantially planar inlet surface and a plurality of fluid passages, each fluid passage having an inlet at the inlet surface, the improvement comprising:

a dilution module block positioned between and interconnecting the tapered header with the inlet surface of the turbulence generator, said dilution module block including:

a plurality of through holes, each said through hole interconnecting the tapered header with at least one inlet of the turbulence generator;

a plurality of feed channels each said feed channel being in fluid communication with at least one said through hole and configured for transporting dilution water to said corresponding at least one through hole; and a plurality of inserts, each said insert having a circular cross section and a radially outwardly projecting flange positioned adjacent to said turbulence generator, each said insert disposed within a corresponding said through hole and including a primary opening and a side entry hole, said primary opening interconnecting the tapered header with a corresponding inlet of the turbulence generator, said side entry hole interconnecting said primary opening with a corresponding said feed channel, each said insert having an axial face adjacent to the turbulence generator and a continuous groove in said axial face surrounding said primary opening; and at least one seal, each said seal being disposed in a corresponding one of said continuous grooves.

20. In a paper-making machine, a dilution control device interconnecting a tapered header with a turbulence generator, the turbulence generator including a substantially planar inlet surface and a plurality of fluid passages, each fluid passage having an inlet at the inlet surface, the improvement comprising:

a dilution module block positioned between and interconnecting the tapered header with the inlet surface of the turbulence generator, said dilution module block including:

a plurality of through holes, each said through hole interconnecting the tapered header with at least one inlet of the turbulence generator;

a plurality of feed channels each said feed channel being in fluid communication with at least one said through hole and configured for transporting dilution water to said corresponding at least one through hole; and a plurality of inserts, each said insert disposed within a corresponding said through hole and including a primary opening and a side entry hole, said primary opening interconnecting the tapered header with a corresponding inlet of the turbulence generator, said side entry hole interconnecting said primary opening with a corresponding said feed channel, each said insert having an axial face adjacent to the turbulence generator and a continuous groove in said axial face surrounding said primary opening; and at least one seal, each said seal being disposed in a corresponding one of said continuous grooves.

21. A wet end of a paper-making machine, comprising:

a headbox including a chamber and a discharge nozzle;

a turbulence generator connected with said headbox, said turbulence generator including a substantially planar inlet surface and a plurality of fluid passages, said plurality of fluid passages disposed substantially parallel to each other, each said fluid passage being in fluid communication with said headbox chamber and having an inlet at said inlet surface;

a tapered header having an interior duct for transporting headbox consistency fiber stock;

a dilution module block positioned between and interconnecting said tapered header with said inlet surface of said turbulence generator, said dilution module block including a plurality of through holes and a plurality of feed channels, each said through hole interconnecting said interior duct of said tapered header with at least one said inlet of said turbulence generator, each said feed channel being in fluid communication with at least one said through hole and configured for transporting dilution water to said corresponding at least one through hole; and at least one seal, each said seal abutting said inlet surface of said turbulence generator and substantially surrounding each said inlet of said turbulence generator fluid passages.

22. The wet end of claim 21, wherein said dilution module block further comprises a plurality of inserts, each said insert disposed within a corresponding said through hole and including a primary opening and a side entry hole, said primary opening interconnecting said interior duct of said tapered header with a corresponding said inlet of said turbulence generator, said side entry hole interconnecting said primary opening with a corresponding said feed channel.

* * * * *

UNITED STATES PATENT AND TRADEMARK OFFICE

CERTIFICATE OF CORRECTION

PATENT NO. : 6,083,351
DATED : July 4, 2000
INVENTOR(S) : Edwin X. Graf, et al.

It is certified that error appears in the above-identified patent and that said Letters Patent is hereby corrected as shown below:

COLUMN 5

Line 46, delete "24" and substitute --2-4-- therefor.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*